US005556685A

United States Patent [19]

Swicegood, Jr.

[11] Patent Number: 5,556,685

[45] Date of Patent: Sep. 17, 1996

[54] SHOE WIPING MAT ASSEMBLY

[76] Inventor: Glenn M. Swicegood, Jr., 8514 Kiley Ct., St. Augustine, Fla. 32092

[21] Appl. No.: 507,003

[22] Filed: Jul. 25, 1995

[51] Int. Cl.[6] ..... A47K 7/02; A47L 23/22; B32B 3/02

[52] U.S. Cl. ..... 428/95; 428/85; 15/215; 15/216; 15/217

[58] Field of Search ..... 428/85, 95; 15/215, 15/216, 217

[56] References Cited

U.S. PATENT DOCUMENTS

| | | | |
|---|---|---|---|
| 2,604,377 | 7/1952 | Eames | 15/217 |
| 3,696,459 | 10/1972 | Kucera et al. | 15/217 |
| 4,353,944 | 10/1982 | Tarui | 15/217 |
| 5,071,628 | 12/1991 | Alazet | 15/215 |

FOREIGN PATENT DOCUMENTS

| | | | |
|---|---|---|---|
| 4103962 | 8/1992 | Germany | 15/216 |

*Primary Examiner*—Terrel Morris
*Attorney, Agent, or Firm*—Thomas C. Saitta

[57] ABSTRACT

A show wiping mat assembly having a liquid retention compartment containing a liquid, support means to support the soles of a user a distance above the bottom of the liquid retention compartment and slightly below the surface of the liquid, and cleaning means such as bristles which extend slightly above both the support means and the liquid surface.

14 Claims, 1 Drawing Sheet

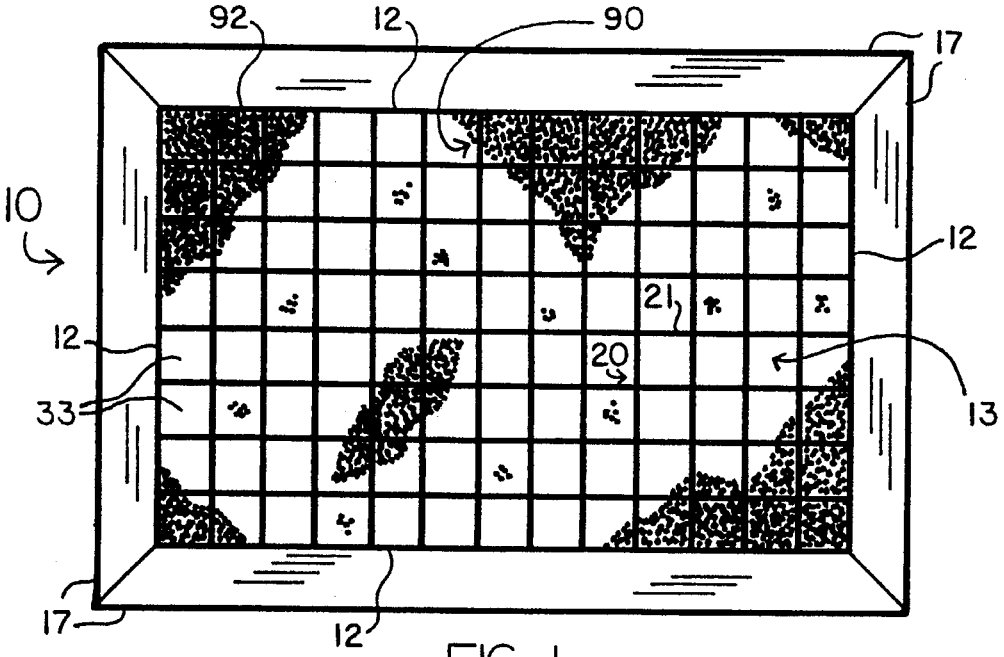
FIG 1
FIG 2
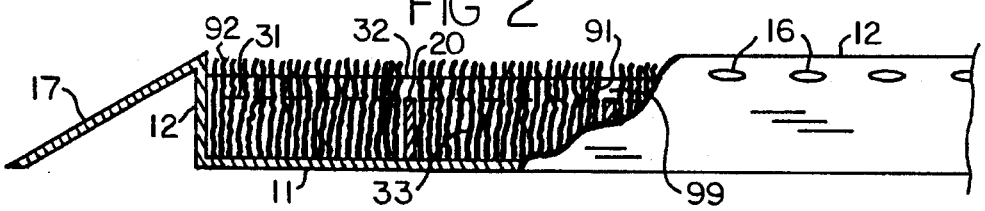
FIG 3
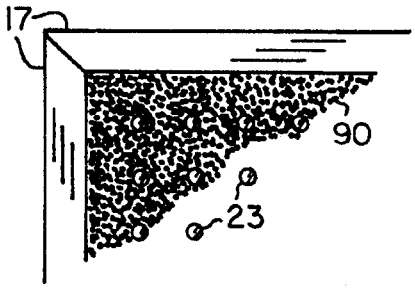
FIG 4
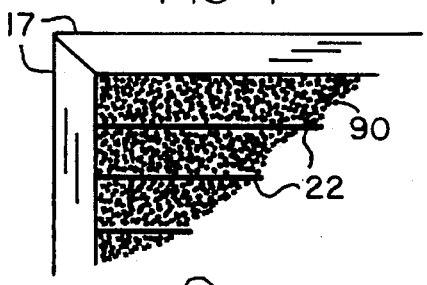
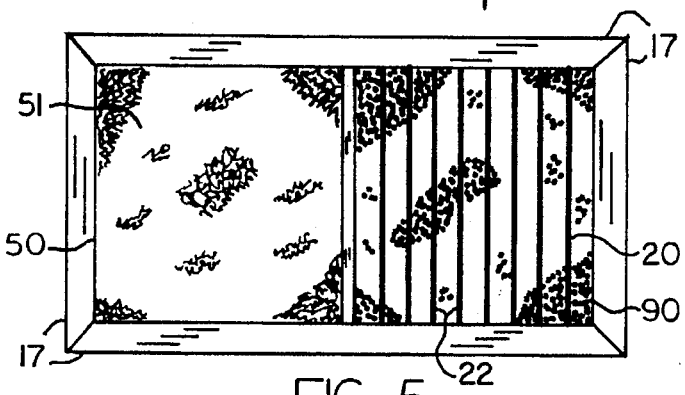
FIG 5

SHOE WIPING MAT ASSEMBLY

BACKGROUND OF THE INVENTION

The invention relates generally to the field of mat assemblies adapted to be positioned on the floor or ground and used for cleaning dirt, debris, etc. from the soles of shoes by the user wiping the soles across the surface of the mat. More particularly, the invention relates to such mats which incorporate the combination of wiping bristles and a liquid to increase the effectiveness of the assembly.

A number of shoe wiping mats are known, and many utilize the concept of a shallow tray assembly including brushing means, such as bristles, scrappers or fibrous mats, combined with a liquid such as water or a cleaning/disinfectant solution. Examples of such assemblies are shown in U.S. Pat. No. 2,282,672 to Nelson, No. 2,604,377 to Eames, No. 3,696,459 to Kucera et al., No. 4,425,677 to Cox, No. 4,793,018 to Ehrich, No. 4,866,805 to Oden at al., and No. 5,297,309 to Rotoli. None of the known prior art however, provides for the most efficient cleaning, as the prior constructions do not optimize the desirable features of the cleaning implements and the liquid component.

It is an object of this invention to provide a shoe cleaning mat assembly which combines a liquid containing reservoir for exposing the soles of the shoes to a liquid cleaning solution and a cleaning means capable of brushing or scrapping debris trapped within in the crevices or cavities of treaded soles or the like. It is a further object to create such an assembly which further incorporates support means to maintain the soles at the optimum depth in the liquid while simultaneously creating a recess or sump area to receive the removed debris to prevent it from being reapplied to subsequent users. It is a still further object to provide such an assembly where the liquid level is maintained at an optimum level slightly above the support means but slightly below the tops of the cleaning means, which are preferably bristles composed of natural or synthetic materials.

SUMMARY OF THE INVENTION

The invention is a shoe wiping mat assembly suitable for use in multiple applications where it is necessary or desirable to remove dirt, sand, debris or any other material adhering to the soles of shoes. The invention is especially suited for cleaning shoes having crevices or ridges on the soles defining channels and ridges in which debris can remain trapped even after wiping on ordinary mats, and is in particular suited for treaded shoes, such as tennis, running or boat shoes, cleated shoes, such as golf shoes, or work boots. The combination of wiping bristles and liquid contact increases the cleaning efficiency of the device.

The shoe wiping mat assembly comprises in general a four sided shallow tray formed of four generally short upstanding side walls and a bottom, which in conjunction define a liquid retention compartment. Within the liquid retention compartment are relatively rigid, relatively non-compressible support means, which may comprise a grid, ridges,or posts, extending upwardly from the bottom of the tray whereby the upper edges or ends of the support means create a generally horizontally disposed surface of suitable strength to maintain the weight of a person standing upon the support means without compressing. The support means occupy a minimal area of the horizontal support surface, such that the large majority of the support surface is open.

Extending upwardly from the bottom of the tray and generally filling the open areas of the support surface are a large number of bristles, composed of natural or synthetic material which is relatively rigid yet able to flex or bend to some degree as the soles are wiped cross them. The bristles extend a short distance above the support surface formed by the support means such that they will extend into the crevices and cavities of the shoe soles when the person stands on the support means. A cleaning liquid, such as water or any other suitable cleaning or disinfecting solution, is placed in the liquid retention compartment. The upper surface of the water is maintained at a level above the support surface yet below the upper ends of the bristles, such that the soles of the shoes will be wetted by the liquid, and below the ends of the bristles, such that the bristles extend above the liquid level. The height of the liquid is properly maintained either by sizing the height of the size walls to be the proper distance, or by providing drain apertures at the proper height in the side walls.

The flexibility of the bristles create a brushing or scraping action when shoes are wiped on the mat, and the liquid increases the cleaning effectiveness by loosening or dissolving the adhered particles. The support means prevent the soles from sinking too deeply into the liquid and concurrently provide space for dirt, sand and other debris to collect below the support surface so that subsequent users will encounter a clean wiping surface. In a preferred embodiment, the assembly further comprises sloped surfaces extending outwardly from at or near the top edges of side walls to form one or more ramps. The assembly may also be constructed to provide a separate compartment or area for placement of an absorbent material, such as cloth, carpet or sponge, to remove the liquid from the soles after they have been cleaned.

BRIEF DESCRIPTION OF THE DRAWINGS

FIG. 1 is a top view of the invention.

FIG. 2 is a side view of an embodiment of the invention having only two ramps, with a portion of the side wall removed to expose the cleaning means, liquid and support means.

FIG. 3 is a partial top view of an alternate embodiment of the invention, showing posts as the support means.

FIG. 4 is a partial top view of another alternate embodiment of the invention, showing ridges as the support means.

FIG. 5 is a top view of another alternate embodiment, in which the assembly further comprises a separate chamber containing an absorbent material.

DETAILED DESCRIPTION OF THE INVENTION

The invention will now be described in detail with reference to the drawings and with regard to the best mode and preferred embodiment. As shown primarily in FIGS. 1 and 2, the invention is a shoe wiping mat assembly 10 which comprises in general a bottom member 11 and side wall members 12 joined to form a unitary liquid retention compartment 13. The overall configuration of the invention is that of a shallow, rectangular tray having relatively short, generally upstanding side walls 12 and a relatively large bottom 11 presenting an upper surface area of sufficient area to extend beyond the edge of standard shoes in all directions when a person is standing on the assembly 10 with both feet. For example, the preferred dimensions for the side wall 12 height range approximately from 0.875 inches to 1.375 inches, and the preferred size for the bottom 11 is approximately 18 inches by 26 inches, but of course the particular dimensions are a matter of design choice. For ease of manufacture and durability, it is preferred that the bottom 11 and side walls 12 be composed entirely of plastic materials, but other materials having sufficient liquid impermeability, strength and flexibility may be substituted. Likewise, while a rectangular configuration is shown in the drawings, other shapes are possible as well.

As shown in FIG. 1, the interior of the liquid compartment 13 is substantially filled with support means 20 and cleaning means 90. Support means 20 are relatively rigid, relatively non-compressible members interspaced within the liquid compartment 13, preferably but not necessarily made of a hard plastic, capable of sustaining the weight of a person without significant compression in order to maintain the shoe soles a distance above the bottom member 11. The support means may be constructed in various configurations, such as that of a grid 21 as shown in FIG. 1, plural ridges 22 as shown in FIG. 3, or plural posts 23 as shown in FIG. 4. The upper portions of the support means 20 form a generally horizontally disposed support surface 31, as shown in FIG. 2. The support surface 31 is primarily open to the bottom 11, such that the support means 20 occupy only a relatively minimal part of the entire surface area of the support surface 31 with a large number of open sump areas 33 being present. Preferably, the support means 20 are kept to the minimum size and number required to maintain the bottom of the user's shoe at the proper height. For example, as in FIG. 1, where the support means comprises a grid 21, it is preferred that the width of individual ridges forming the grid 21 be approximately 0.125 inches, with each open sump area 33 being approximately 2 inches by 2 inches in size. Similarly, the ridges 22 shown in FIG. 4, which can be parallel, curved, angled, etc., should be sized and separated in the same relation, and the posts 23 shown in FIG. 3 should be relatively small in diameter and separated the maximum distance to still provide suitable support to the user. The support means 20 may be formed as an integral part of the bottom 11 or may comprise a separate component placed into the liquid retention area 13. In the preferred embodiment, the height of the support surface 31 is approximately 0.75 inches from the bottom 11.

Extending upwardly from the bottom 11 of the liquid retention compartment 13 between the support means 20 are cleaning means 90, which preferably comprise a large number of relatively rigid but somewhat flexible members, such as bristles 91 made from either natural or synthetic materials. It is preferred that the cleaning means 90 be composed of plastic and be similar in configuration and composition to known products referred to as indoor/outdoor carpet, although in this application the bristles 91 should be longer than those present in the carpet application, having a length of approximately 1 inch above the bottom 11 when used in combination with support means 20 creating a support surface of 0.75 inches. It is preferred that the bristles 91 occupy and fill the majority of the space between the support means 20, although the bristles 91 may also be positioned in rows, tufts, or the like. The bristles 91 are adapted to provide a means to extract dirt, sand, debris, etc. from within the crevices and cavities of the soles of treaded shoes such as tennis, running or boat shoes, as well as golf shoes or work boots, by the action of the bristle ends 92 extending into the crevices with the movement of the soles across the mat causing the particles to be brushed or scrapped off of the soles. Therefore, the height of the cleaning means 90 must exceed the height of the support surface 31, since the cleaning means 90, whether bristles 91 or other structures designed to remove the accumulated debris from the soles, must be able to extend into the crevices. On the other hand, the bristle ends 92 should not extend too far above the support surface 31 such that matting or permanent bending of the bristles 91 would occur after extended use of the assembly 10.

To maximize the cleaning efficiency of the assembly 10, the liquid retention compartment 13 is filled with a liquid 99, such as water or other suitable cleaning or disinfecting solutions. It is important that the surface 32 of the liquid 99 be maintained at a proper height, which is greater than the height of the support surface 31 but less than the height of the cleaning means 90, i.e., the height of the bristle ends 92, with the preferred liquid surface 32 being maintained approximately halfway between the height of the cleaning means 90 and support means 20. To maintain the liquid 99 at the proper height, the assembly may be constructed such that the height of the side walls 12 is equal to the desired height of the liquid surface 32, so that any excess liquid would flow over the tops of the side walls 12. In the preferred construction however, the side walls 14 extend above the liquid surface 32 and are provided with a number of drain apertures 16, shown in FIG. 2, with the bottom edges of the drain apertures 16 positioned at the desired height to allow excess liquid 99 to drain from the liquid retention compartment 13.

The shoe wiping mat assembly 10 operates in the following manner. As seen best in FIG. 2, the support means 20 provide a generally horizontally disposed support surface 31 which acts to maintain the user's shoes a distance above the bottom 11 and prevents the weight of the user from causing the shoe to sink too far into the bristles 91. Because better cleaning occurs when the sole is wetted, the surface 32 of liquid 99 is a short distance above the support surface 31, allowing liquid 99 to penetrate into the crevices and cavities of the soles to dissolve some debris and to soften or ease removal of other debris. The support means 20 prevent the shoes form getting too deep in to the liquid 99. With the bristle ends 92 extending above the liquid surface 32, maximum cleaning is effected. As the shoes are wiped across the mat 10, the flexible bristles 91 remove debris. The extended bristles 91 also keep any splashing to a minimum when the user steps onto the assembly 10. Because the support means 20 are kept to a minimum relative to the total surface of the assembly 10, numerous sump areas 33 are present to receive dirt and debris removed form the shoes. Since the debris settles to the bottom of the sump areas 33, the area at and above the support surface 31 are kept relatively clean, such that removed debris from one user is not redeposited onto the soles of the next user. The large number of bristles 91 and the support means 20 also prevent any liquid movement below the support surface which might stir up the settled debris.

In the preferred embodiment as shown in FIGS. 1 and 2, the outer portions of the side walls 12 are provided with a sloping or angled upper surface to form one or more ramp members 17. The ramp members 17 provide easier access to the assembly 10. In an alternative embodiment shown in FIG. 5, the mat assembly 10 is provided with an absorbent means 51 adjacent to liquid retention compartment 13, which may be comprised of a cloth, carpet or sponge type material, either attached to a hard surface or positioned within an absorbent compartment 50 formed similar to the liquid retention compartment 13. The absorbent means 51 is used to remove any residual liquid 99 remaining on the soles after they have been cleaned in the liquid retention compartment 13, which is particularly desirable for indoor applications.

It is contemplated that equivalents and substitutions for certain components and elements may be obvious to those skilled in the art, so the true scope and definition of the invention therefore is to be as set forth in the following claims.

I claim:

1. A shoe wiping mat assembly comprising:

(A) a liquid retention compartment formed by the combination of a bottom member and a number of generally upstanding side walls, said liquid retention compartment containing a liquid having an upper surface;

(B) support means positioned within said liquid retention compartment, said support means comprising relatively rigid and non-compressible members which combine to create a generally horizontal support surface capable of supporting the soles of shoes a distance above said bottom member, said support surface having a number of open areas and said support surface being positioned below said upper surface of said liquid;

(C) cleaning means positioned within said liquid retention compartment, said cleaning means extending above said bottom, said support means, said support surface and said upper surface of said liquid.

2. The device of claim 1, where said cleaning means comprises a plural number of bristles.

3. The device of claim 1, further comprising drain apertures positioned in said side walls to maintain said upper surface of said liquid at a predetermined height.

4. The device of claim 1, where said support means comprises a grid member.

5. The device of claim 1, where said support means comprises a plural number of ridges.

6. The device of claim 1, where said support means comprises a plural number of posts.

7. The device of claim 1, where said cleaning means extends upwardly from said bottom and through said open areas in said support surface.

8. The device of claim 1, further comprising one or more ramps extending outwardly from said side walls.

9. The device of claim 1, further comprising absorbent means positioned adjacent said liquid retention compartment for absorption of said liquid from the soles of shoes.

10. The device of claim 1, where said support means is attached to said bottom.

11. The device of claim 1, where said cleaning means is attached to said bottom.

12. The device of claim 1, where said support means is separate from and rests on said bottom.

13. The device of claim 1, where said cleaning means is separate from and rests on said bottom.

14. The device of claim 1, where said support means creates a sump area in the bottom of said liquid retention compartment to receive debris.

* * * * *